US005408763A

United States Patent [19]

Sartor et al.

[11] Patent Number: 5,408,763

[45] Date of Patent: Apr. 25, 1995

[54] SKATE WITH ALIGNED WHEELS HAVING AN ADJUSTABLE QUARTER

[75] Inventors: Mariano Sartor, Montebelluna; Massimo Foffano, Treviso, both of Italy

[73] Assignees: Nordica S.p.A., Italy; Rollerblade, Inc., Minnetonka, Minn.

[21] Appl. No.: 30,396

[22] PCT Filed: Feb. 24, 1992

[86] PCT No.: PCT/EP92/00387

§ 371 Date: Mar. 23, 1993

§ 102(e) Date: Mar. 23, 1993

[87] PCT Pub. No.: WO93/02580

PCT Pub. Date: Feb. 18, 1993

[30] Foreign Application Priority Data

Aug. 2, 1991 [IT] Italy ..... MI91U00724

[51] Int. Cl.[6] ..... A43B 7/20

[52] U.S. Cl. ..... 36/115; 36/89; 36/121

[58] Field of Search ..... 36/117–121, 36/115, 114, 109, 89, 88, 50.1, 132, 136, 50.5

[56] References Cited

U.S. PATENT DOCUMENTS

| | | | |
|---|---|---|---|
| 2,733,065 | 1/1956 | Barkschat | 36/115 |
| 2,789,374 | 4/1957 | Planert . | |
| 2,972,822 | 2/1961 | Tanner . | |
| 3,570,148 | 3/1971 | Morgan | 36/50.5 |
| 3,732,635 | 5/1973 | Marker | 36/120 |
| 3,824,713 | 7/1974 | Vaccari | 36/118 |
| 4,602,443 | 7/1986 | Spademan | 36/121 |
| 4,899,466 | 2/1990 | Skaja | 36/50.1 |
| 5,038,499 | 8/1991 | Martinez, Jr. | 36/58.5 |
| 5,054,215 | 10/1991 | Tonel et al. | 36/120 |

FOREIGN PATENT DOCUMENTS

| | | | |
|---|---|---|---|
| 1066501 | 11/1979 | Canada | 36/115 |
| 2358848 | 2/1978 | France . | |
| 1932776 | 1/1971 | Germany . | |
| 668682 | 1/1989 | Switzerland . | |

*Primary Examiner*—Steven N. Meyers
*Assistant Examiner*—Thomas P. Hilliard
*Attorney, Agent, or Firm*—Welsh & Katz, Ltd.

[57] ABSTRACT

The skate with aligned wheels includes a shell and a quarter. The quarter is provided with a plurality of holes adapted to engage with a plurality of lugs of the shell for adjusting the position of the quarter on the shell.

6 Claims, 3 Drawing Sheets

SKATE WITH ALIGNED WHEELS HAVING AN ADJUSTABLE QUARTER

TECHNICAL FIELD

The present invention relates to a skate with aligned wheels.

BACKGROUND ART

Known skates with aligned wheels are currently constituted by a wheel support member associated with the sole of a rigid shell.

The problems observed in these known types of skate essentially consist of the fact that they do not optimally support the user's leg according to the different requirements which arise in the various sports specialties, such as speed skating or figure skating.

The use of levers in fact merely allows to secure the flaps of the shell more or less tightly, without allowing any adjustment to its fit.

It is not possible to transfer a solution from other fields, such as the field of ski boots in which a quarter is used in addition to a shell, because ski boots require a quarter which oscillates with respect to the shell or is in any case pivoted thereto in order to perform the flexing and extension actions necessary for appropriately guiding the skis.

Solutions are known for this purpose, such as the one described in the French patent application No. 7623112 filed on Jul. 23, 1976, disclosing a ski boot including a supporting element interposed between two flaps which are provided at a recess defined on the rear-upper part of the boot and allow the rearward inclination of the skier's leg.

This solution cannot be transferred to a skate with aligned wheels, since an optimum securing and support of the leg must be achieved at all times.

A Swiss patent application No. CH 668 682 A5 filed on Jun. 6, 1986, is also known which relates to a ski boot comprising a quarter which is articulated to a shell and is provided with securing means which interact, at one end, with the quarter by virtue of vertically adjustable fixing means; securing can be improved for this solution, too, according to the inclination of the quarter.

This known solution cannot be used for a skate with aligned wheels, because the adjustment of the inclination of the shell does not have to be achieved.

DISCLOSURE OF THE INVENTION

The aim of the present invention is therefore to eliminate the problems described above in known types by providing a skate which allows to achieve an optimum support and securing of the user's leg.

Within the scope of the above aim, another important object is to provide a skate which allows the user to rapidly and easily vary the degree of leg support according to the type of sport and thus depending on whether he has to speed skate or figure skate.

Another important object is to provide a structurally simple skate, easy to industrialize, reliable and safe in use and with low manufacturing costs.

This aim, these objects and others which will become apparent hereinafter are achieved by a skate with aligned wheels comprising a support for the sole of a shell, characterized in that at least one quarter is associated with said shell, said quarter being vertically adjustable with respect to said shell.

BRIEF DESCRIPTION OF THE DRAWINGS

Further characteristics and advantages of the invention will become apparent from the detailed description of a particular embodiment, illustrated only by way of non-limitative example in the accompanying drawings, wherein.

WAYS OF CARRYING OUT THE INVENTION

Figure 3:
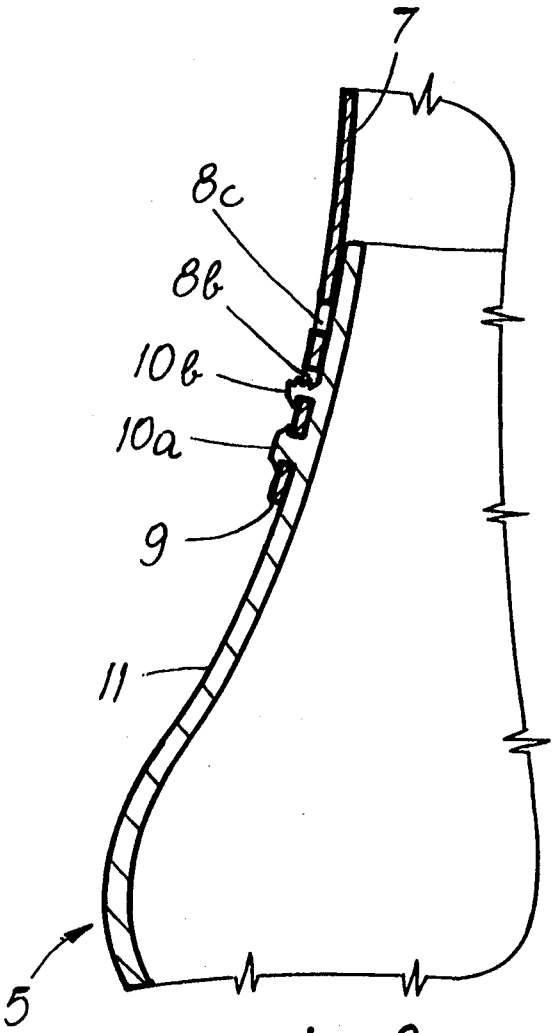
FIG. 3 is a sectional view, taken along a longitudinal median plane, of the skate with the quarter arranged as in FIG. 1.
Figure 2:
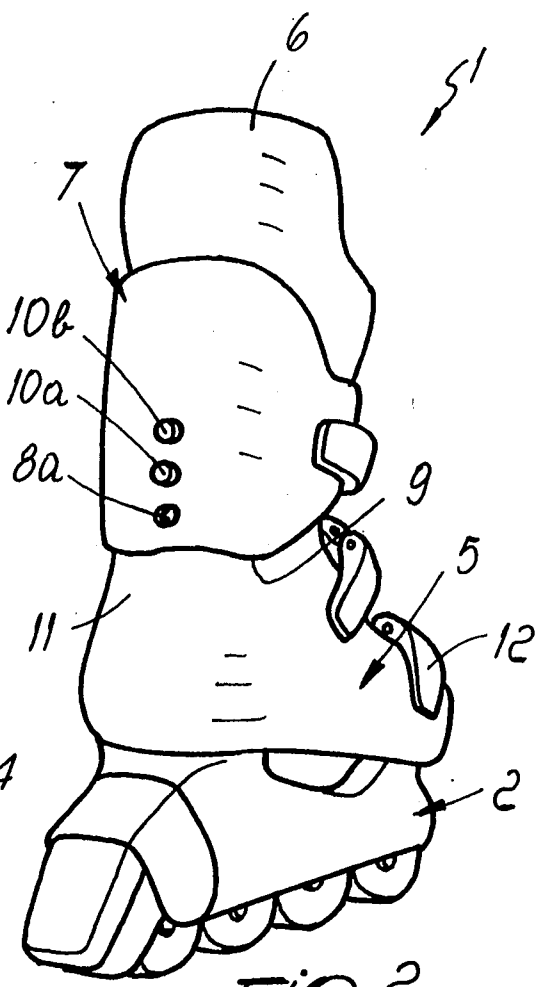
FIG. 2 is a view, similar to the preceding one, of the skate with the quarter lowered.
Figure 1:
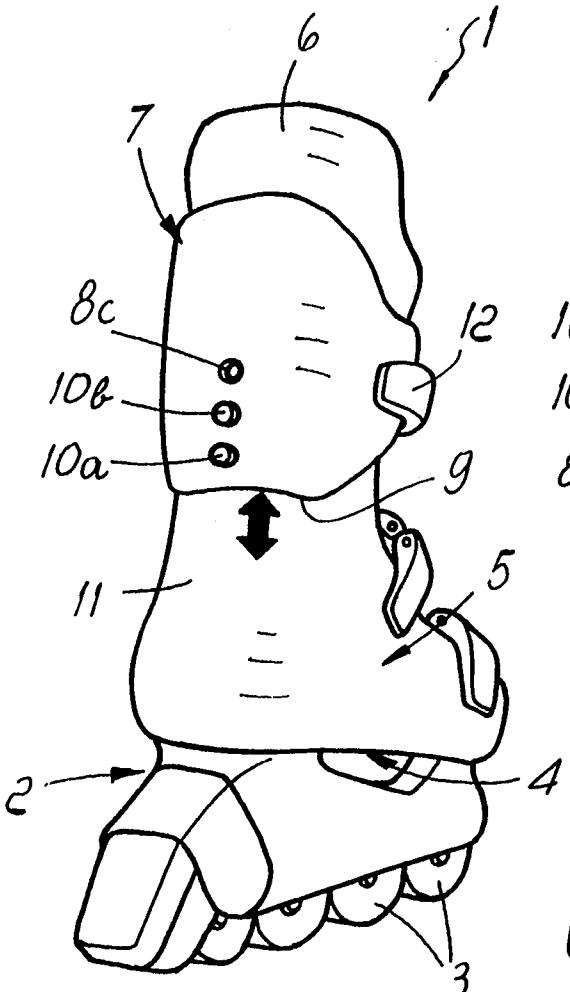
FIG. 1 is a rear perspective view of a skate according to the invention.

With reference to the above figures, the skate, generally designated by the reference numeral 1, is constituted by a support 2, for aligned wheels 3, associated with the sole 4 of a shell 5. An innerboot 6 can be arranged inside shell 5.

A quarter 7 is externally associated with the shell 5, at least partially embraces the user's leg and is provided with means for temporary engagement with complementarily shaped grip means which are associated with the shell and are suitable for vertically adjusting the position of the quarter with respect to the shell.

The temporary engagement means are constituted by a plurality of holes, which in the particular embodiment are three and are designated by the numerals **8*a*, 8*b* and 8*c***.

Said holes are defined along the longitudinal axis of said quarter 7 starting from the lower perimetric edge 9 thereof.

The grip means are constituted by a plurality of lugs, which in the particular embodiment are two and are designated by the numerals **10*a* and 10*b***.

Said lugs protrude from the rear surface 11 of the shell along a same longitudinal axis, which coincides with the axis along which the holes **8*a*, 8*b* and 8*c*** are defined.

Advantageously, said lugs have a mushroom-like shape suitable for allowing a better temporary coupling thereof at the holes.

The use of the skate is as follows: while the skate is not being worn, the user places the quarter 7 in the selected position, and thus at the required height, with respect to the shell; he then inserts his foot in the innerboot 6, arranged inside the shell 5, and secures the shell and the quarter 7 by virtue of adapted securing means such as levers 12 for tensioning cables, straps or metallic rings to tension.

Thus, once the quarter has been arranged at the required height, so as to optimally support the user's leg, he/she secures the shell and the quarter in order to start practicing the sport in the optimum condition.

This operation is allowed by virtue of the presence of the lugs arranged on the rear surface of said shell and of the holes defined on the quarter.

It has thus been observed that the invention has achieved the intended aim and objects, a skate having been provided which allows to achieve an optimum and selective adjustment of the vertical position of the quarter with respect to the shell, allowing to optimally support the user's leg.

This adjustment is performed rapidly and easily according to the type of sport and thus according to whether the user must engage in a speed or slalom test.

Figure 4:
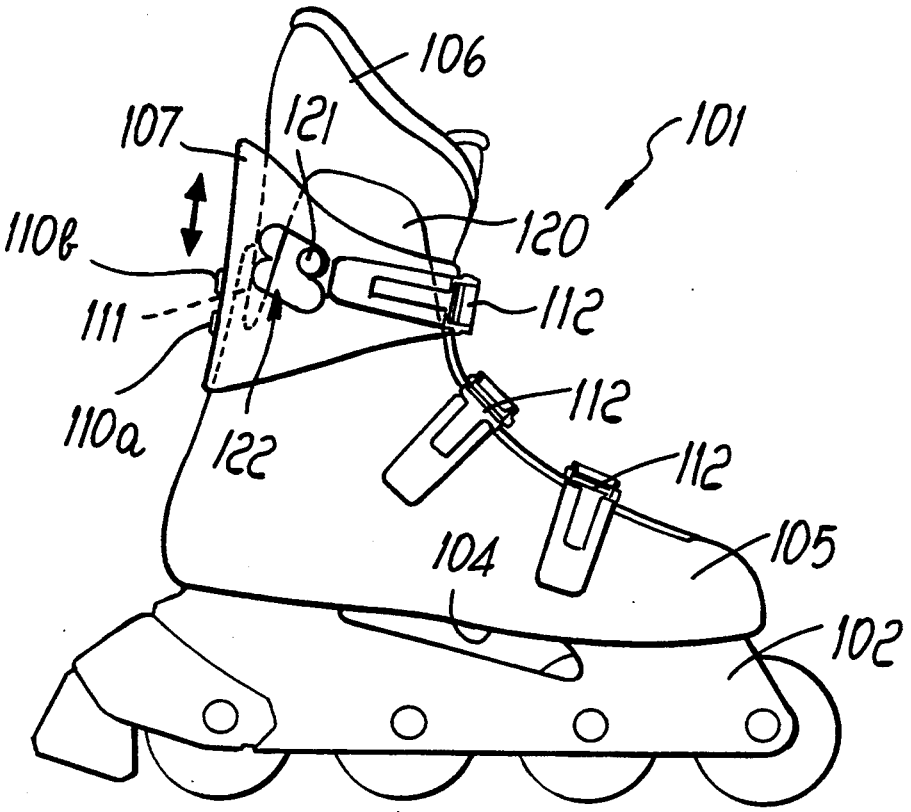
FIG. 4 is a side view of a skate, according to a second aspect of the invention, with the quarter in a lower position.
Figure 5:
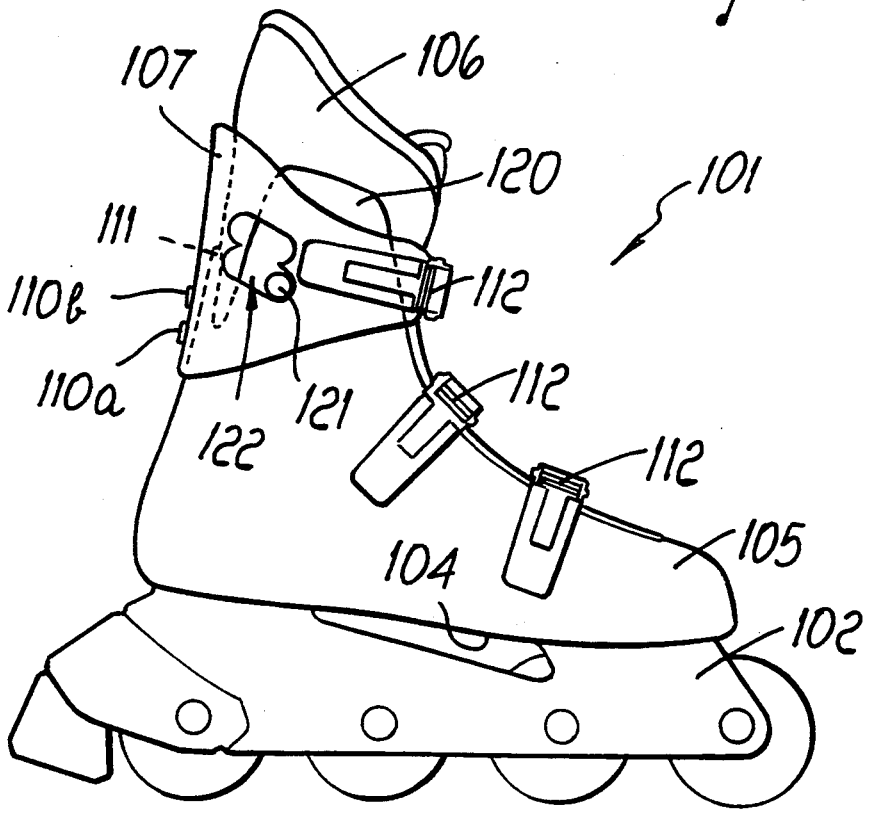
FIG. 5 is a side view of the skate of FIG. 4, with the quarter in a higher position.
Figure 7:
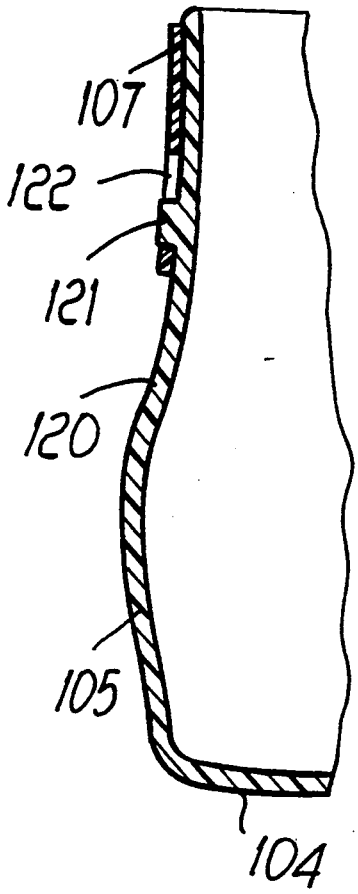
FIG. 7 is a partial cross section view of the shell and quarter of the skate of FIGS. 4–5.
Figure 6:
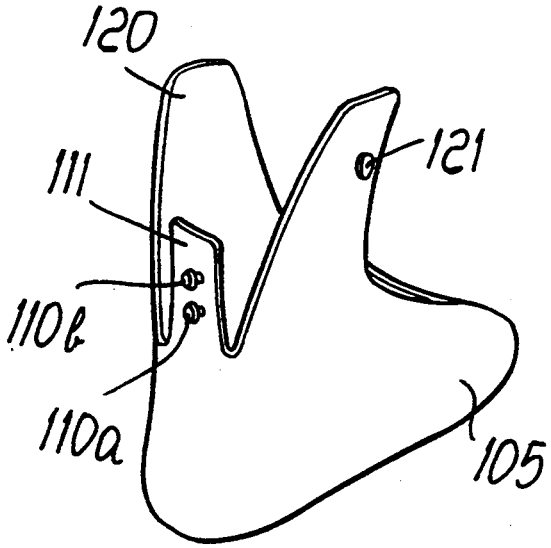
FIG. 6 is a rear perspective view of the shell of the skate of FIGS. 4–5.
Figure 8:
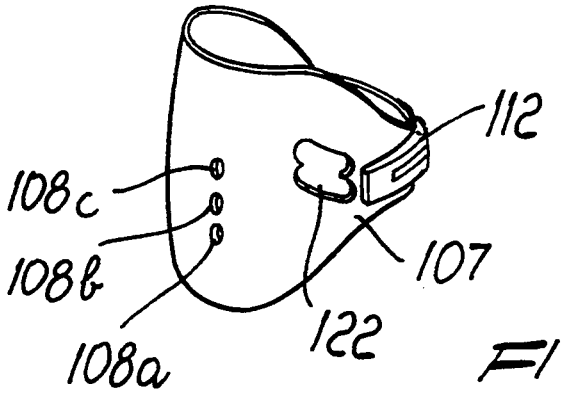
FIG. 8 is a perspective view of the quarter of the skate of FIGS. 4–5.

FIGS. 4–7 illustrate a skate 101 according to a further aspect of the invention.

A wheel support 102 is associated with the sole 104 of a shell 105. An inner boot 106 is arranged inside the shell 105. Shell 105 comprises a rear flap 111 and side members 120; the rear flap 111 comprises lugs 110*a* and 110*b* while each side member 120 includes a pivot member 121.

The skate 101 also includes a quarter 107 embracing the shell 105 at the rear flap and side members. Quarter 107 has a fastening member 112, such as a per se known lever. Fastening members 112 are also provided on shell 105.

Quarter 107 comprises a plurality of holes 108*a*, 108*b*, 108*c*, on its rear portion and the lugs 110 are adapted to engage in the holes 108 for adjusting the height of the quarter on the shell.

Quarter 102 is also provided with a slot 122, at each side, adapted to engage the pivot member 121 on the shell. The slot 122 allows the quarter 107 a certain rotation, determined by the length of the slot, and at the same time provides for a limit stop to the rearward motion of the quarter.

In the illustrated example, the shell 105 is provided with two lugs 110 while the quarter has three holes 108 thereby providing for two positions of the quarter 107; correspondingly, the slot 122 is shaped as a double slot. Of course, the quarter may have more than two positions on the shell (for example three, by providing four lugs on the rear flap) and the slot 122 would be accordingly shaped in order to let the pivot 121 slide in the different positions.

In the illustrated preferred embodiment, there is one lug 121 at each side member 120 of the shell and a corresponding slot 122 at each side of the quarter 107, but only one lug 121 and corresponding slot 122 could be provided on just one side of shell and quarter.

The materials and the dimensions of the individual elements which constitute the skate, as well as the number of holes defined on the quarter and the number of lugs defined on the shell, may naturally be the most appropriate according to the specific requirements; furthermore, the holes might be provided on the shell and the lugs might be provided on the quarter.

Where technical features mentioned in any claim are followed by reference signs, those reference signs have been included for the sole purpose of increasing the intelligibility of the claims and accordingly, such reference signs do not have any limiting effect on the scope of each element identified by way of example by such reference signs.

What is claimed is:

1. A skate boot comprising:

a shell for supporting a user's foot portion, said shell having a lower sole and an upwardly extending portion arranged for supporting a user's ankle and heel regions, said upwardly extending portion extending along a substantially vertical extension;

at least one quarter; and connecting means for adjustably connecting said at least one quarter to said upwardly extending portion of said shell in a selectable one of at least two positions along said vertical extension thereby said quarter being adjustably positionable in a substantially vertical direction with respect to the upwardly extending portion of said shell;

wherein said upward extending portion of said shell comprises a pair of lateral members arranged mutually opposite for supporting a user's ankle region; and wherein the skate boot comprises;

at least one arrangement of at least one pivot member and at least two slot elements releasably connected between at least one of said pair of lateral members and a side portion of said quarter, said at least two slot elements both extending in a direction substantially perpendicular to said vertical extension of said upwardly extending portion of said shell, and said at least two slot elements being mutually arranged one above the other in a line substantially parallel to said vertical extension, and said pivot member being engaged in a selected one of said at least two slot elements, in which said selected one of said at least two slot elements is a first slot element when said selected one of said at least two positions is a lower arranged position with respect to said vertical extension, and in which said selected one of said at least two slot elements is a second slot element when said selected one of said at least two positions is an upper-arranged position with respect to said vertical extension, wherein said quarter is releasably closable in a forward direction, and wherein the skate further comprises means for releasably closing said quarter in a forward direction.

2. The skate boot of claim 1, further comprising:

a plurality of substantially aligned wheels; and means connected to said sole for rotatably supporting said plurality of aligned wheels.

3. A skate boot comprising:

a shell for supporting a user's foot portion, said shell having a lower sole and an upwardly extending portion arranged for supporting a user's ankle and heel regions, said upwardly extending portion extending along a substantially vertical extension;

at least one quarter; and connecting means for adjustably connecting said at least one quarter to said upwardly extending portion of said shell in a selectable one of at least two positions along said vertical extension thereby said quarter being adjustably positionable in a substantially vertical direction with respect to the upwardly extending portion of said shell;

wherein said upward extending portion of said shell comprises a pair of lateral members arranged mutually opposite for supporting a user's ankle region; and wherein the skate boot comprises;

at least one arrangement of at least one pivot member and at least two slot elements releasably connected between at least one of said pair of lateral members and a side portion of said quarter, said at least two slot elements both extending in a direction substantially perpendicular to said vertical extension of said upwardly extending portion of said shell, and said at least two slot elements being mutually arranged one above the other in a line substantially parallel to said vertical extension, and said pivot member being engaged in a selected one of said at least two slot elements, in which said selected one of said at least two slot elements is a first slot element when said selected one of said at least two positions is a lower arranged position with respect to said vertical extension, and in which said selected one of said at least two slot elements is a second slot element when said selected one of said at least two positions is an upper-arranged position with respect to said vertical extension, wherein said upwardly extending portion of said shell further comprises a rear flap member, said rear flap member being pivotally movable substantially rearwardly and forwardly with respect to said lateral members; and wherein said connecting means comprise:

an arrangement of at least one lug member and at least two hole elements releasably connected between said rear flap member and a rear portion of said quarter, said at least two hole elements being arranged in a line substantially parallel to the vertical extension of the upwardly extending portion, and said at least one lug member being releasably engaged in a selected one of said at least two hole elements, thereby to releasably connect said rear portion of said quarter to said flap member of said upwardly extending portion of said shell in said selectable position.

4. The skate boot of claim 3, comprising:

a pair of lug members connected to said rear flap member;

three hole elements provided on a side of said quarter; and a single pivot member connected to a lateral member of said upwardly extending portion of the shell.

5. The skate boot of claim 3, comprising a pair of said arrangements of at least one pivot member and at least two slot elements arranged at opposite sides at said lateral members of said upwardly extending portion of said shell.

6. The skate boot of claim 3, wherein said at least one lug member has a mushroom-like shape.

* * * * *